US010486853B1

(12) United States Patent
Schopke et al.

(10) Patent No.: US 10,486,853 B1
(45) Date of Patent: Nov. 26, 2019

(54) ASSEMBLY METHOD FOR CORRUGATED SKID

(71) Applicants: E. Neil Schopke, Rockledge, FL (US); Joseph J. Danko, Apopka, FL (US); Christopher W. Gabrys, Reno, NV (US)

(72) Inventors: E. Neil Schopke, Rockledge, FL (US); Joseph J. Danko, Apopka, FL (US); Christopher W. Gabrys, Reno, NV (US)

( * ) Notice: Subject to any disclaimer, the term of this patent is extended or adjusted under 35 U.S.C. 154(b) by 306 days.

(21) Appl. No.: 15/461,329

(22) Filed: Mar. 16, 2017

Related U.S. Application Data

(63) Continuation-in-part of application No. PCT/US2016/000057, filed on Jul. 11, 2016, and a continuation-in-part of application No. 14/999,860, filed on Jul. 11, 2016, now Pat. No. 9,796,503, and a continuation-in-part of application No. 14/121,062, filed on Jul. 24, 2014.

(60) Provisional application No. 62/309,051, filed on Mar. 16, 2016.

(51) Int. Cl.
*B65D 19/00* (2006.01)

(52) U.S. Cl.
CPC ..... *B65D 19/0026* (2013.01); *B65D 2519/00019* (2013.01); *B65D 2519/00054* (2013.01); *B65D 2519/00273* (2013.01); *B65D 2519/00567* (2013.01); *B65D 2519/00796* (2013.01)

(58) Field of Classification Search
CPC ..... B65D 19/0026; B65D 2519/00796; B65D 2519/067; B65D 2519/19; B65D 2519/00273; B65D 2519/00054
See application file for complete search history.

(56) References Cited

U.S. PATENT DOCUMENTS

| | | | | |
|---|---|---|---|---|
| 2,696,356 A | | 2/1952 | Baumann | |
| 2,856,826 A | * | 10/1958 | Norquist | B31D 5/00 493/417 |
| 2,908,464 A | | 10/1959 | Traudt | |
| 3,911,834 A | | 10/1975 | Quaintance | |
| 5,452,667 A | | 9/1995 | Lim | |
| 5,469,795 A | | 11/1995 | Moorman | |
| 5,528,995 A | | 6/1996 | Lim | |

(Continued)

FOREIGN PATENT DOCUMENTS

DE 4307515 3/1993

*Primary Examiner* — Jacob J Cigna
*Assistant Examiner* — Lee A Holly
(74) *Attorney, Agent, or Firm* — J. Michael Neary

(57) ABSTRACT

A method for assembling a corrugated skid includes selecting first and second planar corrugated blanks and folding the first blank to produce a first double thickness rib that extends out of the plane of the first blank. That blank is placed on a horizontal surface having blades protruding upwards such that the blades penetrate the middle of the double thickness rib and hold it perpendicular to the horizontal surface. The second blank is folded to produce a second double thickness rib that extends out of the plane of the second blank. The second blank is placed on top of the first blank such that the first rib penetrates a slot in the second blank, and the first and second blanks are engaged with one side of each blank facing each other forming a double thickness skid deck with ribs forming depending legs for supporting the skid deck above a supporting surface.

20 Claims, 8 Drawing Sheets

(56) References Cited

U.S. PATENT DOCUMENTS

| | | | |
|---|---|---|---|
| 5,784,971 | A | 7/1998 | Chang |
| 6,029,582 | A | 2/2000 | Ogilvie |
| 6,116,568 | A | 9/2000 | Rosenblat et al. |
| 6,681,704 | B1 | 1/2004 | Bookhiser |
| 7,007,613 | B2 | 3/2006 | Sketo |
| 7,303,519 | B2 | 12/2007 | Jenkins |
| 7,426,890 | B2 | 9/2008 | Olvey |
| 7,980,184 | B2 | 7/2011 | Olvey |

* cited by examiner

ASSEMBLY METHOD FOR CORRUGATED SKID

This is related to and claims priority of Provisional Application 62/309,051 filed on Mar. 16, 2016 and titled "Hand Assembly Method for Corrugated Skids", and is a continuation-in-part of PCT/US2016/00057 filed on Jul. 11, 2016, and U.S. application Ser. No. 14/999,860 filed on Jul. 11, 2016, both entitled "Corrugated Skid".

This invention pertains to shipping platforms for shipping goods, and more particularly to a method for assembly of corrugated skids that allows a high rate of skid assembly with minimized operator fatigue. The assembly method is used to assemble corrugated skids that provide high load capacity from minimal use of corrugated board, using just two die cut blanks, while enabling high volume assembly production on site at a shipper.

BACKGROUND OF THE INVENTION

Pallets are said to move the world. Eighty percent of commerce ships on Pallets. The pallet industry is estimated at greater than $30 B worldwide. More than 500 million pallets are manufactured in the US each year, with 1.8 billion pallets in service in the US alone.

Pallets can be made from various materials, however wood pallets currently comprise about 80% of the market. More than 40% of worldwide hardwood lumber currently goes toward the manufacturing of wood pallets. Other materials used for pallet manufacturing include plastic, metal and corrugated paperboard.

Recent regulations regarding infestation and contamination are creating a surge in interest and use of non-wood pallet alternatives. A small, but fast growing segment is the use of corrugated pallets. Corrugated pallets are typically constructed from corrugated paperboard but they can also be constructed using corrugated plastic. Many pallet users, both shippers and receivers, desire to replace conventional wooden pallets with pallets made of corrugated material for their numerous benefits: increasing ability to recycle, lowering pallet weight, eliminating product contamination, reducing pallet storage volume and costs, and reducing pallet related injuries.

In some applications, material handing is conducted using stacker type forklifts that have front roller forks as well as lifting forks. Stacker forklifts have the advantages of being smaller and more maneuverable than conventional type forklifts and are lower cost. Unfortunately, the front roller forks preclude the use of pallets, or shipping platforms having a bottom deck. Skids are a type of pallet without a bottom deck; they are the shipping platform of choice for these and many other applications. Skids also provide the benefits of easier pallet jack entry than traditional pallets, and can be a solution for widespread shipping applications.

Many different designs of corrugated skids have been developed to date. Despite the potential advantages of corrugated skids, most have suffered from several different deficiencies. These deficiencies include low strength and stiffness, high use of corrugated material, resulting in high material costs, along with high overhead, assembly labor and freight costs. The inherent inability to readily produce and distribute corrugated skids in sufficiently high volume has also been of critical importance.

Accordingly, a new assembly method for corrugated skids is needed that can allow rapid assembly of corrugated skids with minimal tooling set up and tooling costs and can be readily accomplished repeatedly with minimized operator fatigue.

SUMMARY OF THE INVENTION

The invention provides an assembly method for corrugated skids that can be utilized repetitively at a high rate to produce corrugated skids with minimized operator fatigue. The assembly method can use low cost tooling that can be quickly set up, and the assembly workers can quickly be trained, and can also be used in machines assisted by workers or operating autonomously.

The assembly method uses two die-cut blanks to assemble corrugated skids that provide high load capacity while using minimal corrugated board use. It includes selecting two planar corrugated blanks, preferably with pre-scored rib crest and root fold lines. One of the blanks is folded to produce a one or more double thickness ribs that extend out of the plane of the blank, and placed on a horizontal surface having blades protruding upwards. The blades penetrate the middle of the double thickness ribs and hold them perpendicular with the horizontal surface. The other blank is folded to produce one or more second double thickness ribs that extend out of the plane of the other blank. The other blank is placed on top of the first blank, with the first double thickness ribs aligned with a slots in the other blank. One or both blanks are moved such that the first double thickness ribs penetrates slots in the other blank.

Both blanks have notches cut in the ribs. The first blank has notches cut through the crest of the ribs, and corresponding notches are cut in the root of the other blank ribs, aligned with the slots in the other blank that allow the ribs of the first blank to penetrate the other blank. The blades have notches in their top edge that align with the notches in the first blank ribs. The notches in the top edges of the blades accommodate the portion of the other blank above its notches when the two blanks are nested together with the notches aligned. The notches in the ribs of each blank hold the ribs of the opposite blank tightly closed to maintain the supporting strength of the ribs supporting the skid deck.

After the ribs of the first blank have been formed and placed on the blades, it is restrained by end stops that prevent the end ribs from opening while the other blank is nested with the first rib. The blanks are locking together in face-to-face contact to prevent relative parallel lateral translation therebetween to improve the bending stiffness of said skid deck.

DESCRIPTION OF THE DRAWINGS

The invention and its many advantages and features will become better understood upon reading the following detailed description of the preferred embodiments in conjunction with the following drawings, wherein.

DESCRIPTION OF THE PREFERRED EMBODIMENT

Figure 1:
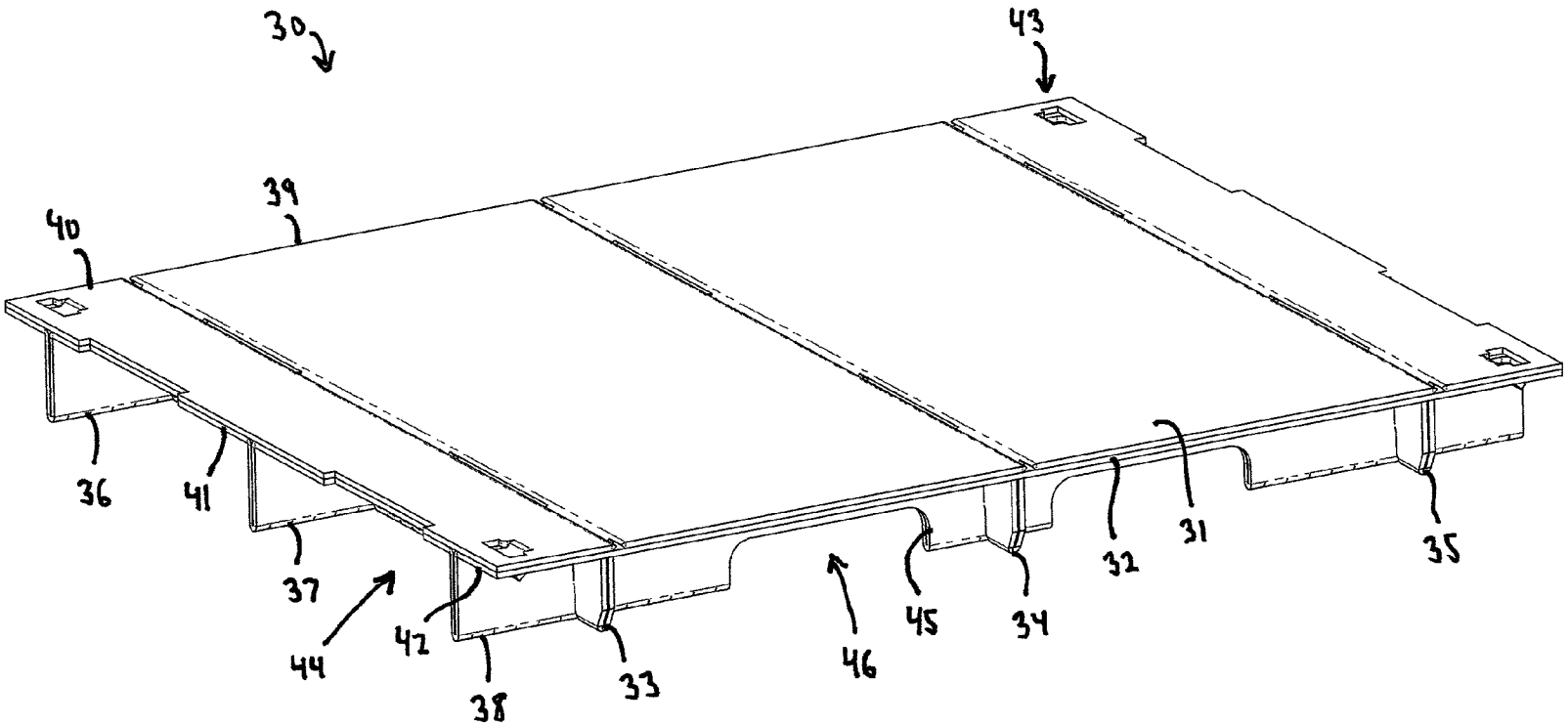
FIG. 1 is an isometric drawing of a corrugated skid assembled using the assembly method for corrugated skids in accordance with the invention.

Turning to the drawings, wherein like reference characters designate identical or corresponding parts, FIG. 1 shows an isometric drawing of a corrugated skid 30 made using the assembly method for corrugated skids in accordance with the invention. The skid 30 is constructed from a top blank 31 and bottom blank 32 that are folded and assembled together to produce a strong, lightweight and durable shipping platform 30. The top blank 31 is folded to produce downward vertically extending multiple ply thickness ribs 33, 34, 35 and deck portions 39, 40. The bottom blank 32 is folded to produce downward vertically extending multiple ply thickness ribs 36, 37, 38 and deck sections 41, 42. The corners of the skid 30 may be locked using corner locks 43. Lifting of the skid is enabled by fork passages 44 and fork lift notches 46 provided by cut out notches 45 in bottom blank ribs 36, 37, 38. Two way or full four way skid configurations are also assemblable using the assembly method for corrugated skids in accordance with the invention.

Figure 2:
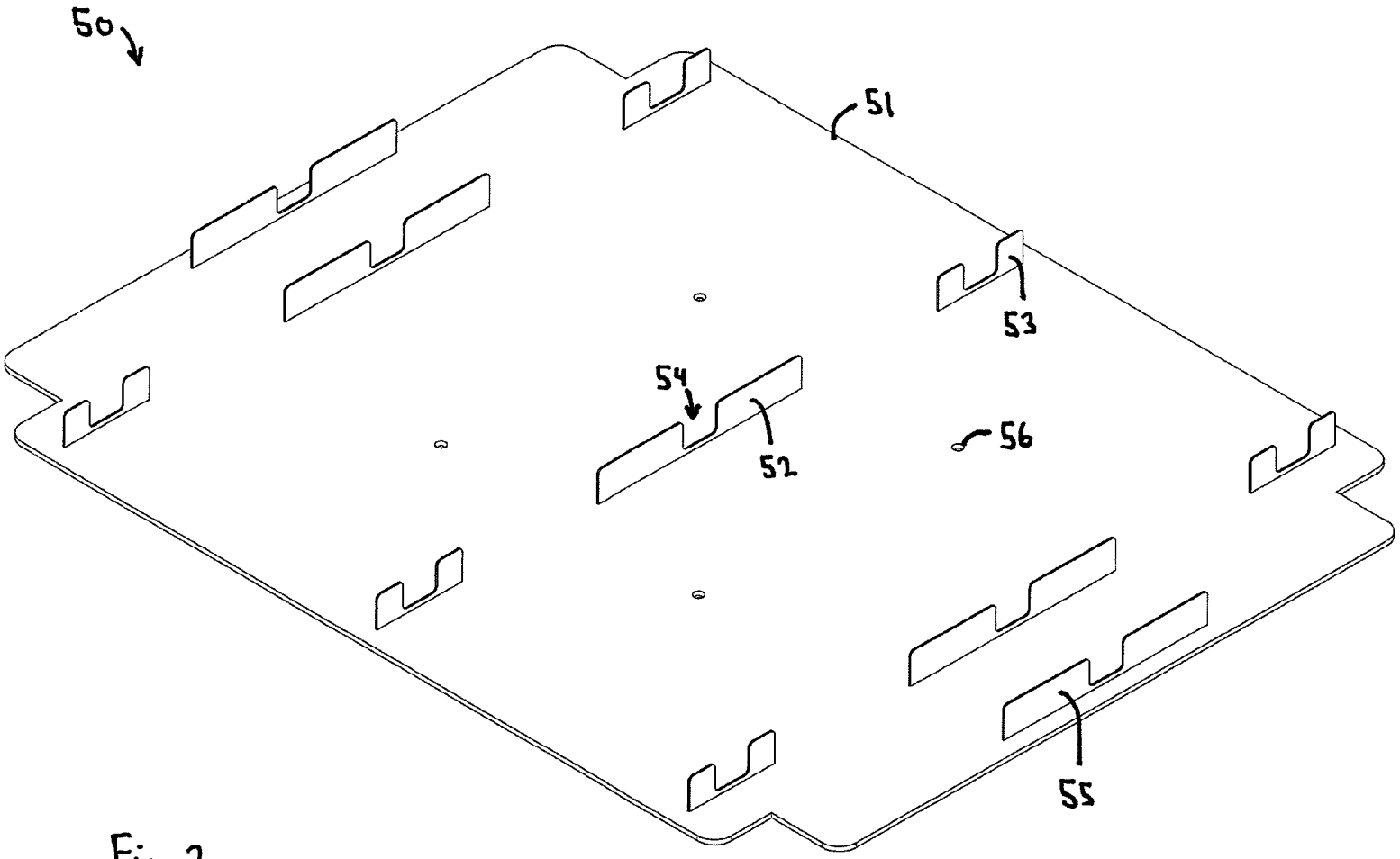
FIG. 2 is an isometric drawing of an assembly jig for use with the assembly method for corrugated skids prior in accordance with the invention.

An isometric drawing of an assembly structure or jig 50 for use with the assembly method for corrugated skids in accordance with the invention, shown in FIG. 2, is comprised of a base plate 51 and multiple side rib blades 53 and center rib blades 52 attached to the base plate in an upright position. Three rows of blades, each including two side blades 53 and one center blade 52 are attached to the base plate, for example in slits in the base plate 51, and spaced apart a distance equal to the spacing apart of the rows of ribs 33, 34 and 35 of the top blank 31. The rows of blades are shown parallel, as are the rows of ribs in FIGS. 4-8, but the rib placement and orientation (and the corresponding blade placement and orientation) may be modified depending on the skid loading distribution of particular applications. Blade notches 54 are preferably provided in blades 52, 53 to allow for clearance of bottom blank ribs during the assembly process. Mounting holes 56 may be provided for securing the assembly jig 50 to a table top or other supporting structure. Alternatively, the base plate 51 can be the top of a table.

Figure 3:
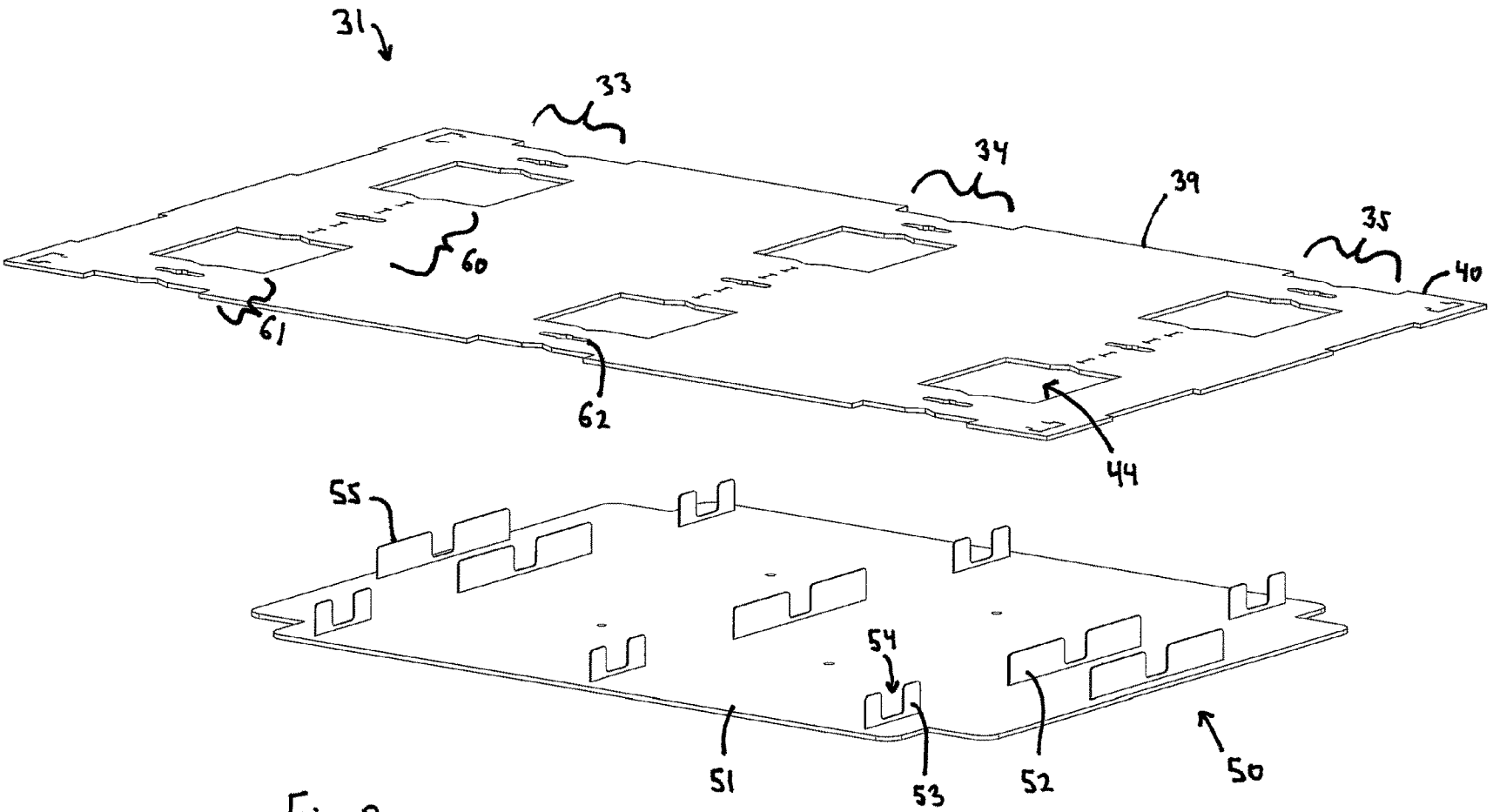
FIG. 3 is an isometric drawing of the assembly jig and top blank readied prior to assembly using the assembly method for corrugated skids in accordance with the invention.

The assembly method for corrugated skid preferably assembles skids upside-down for ease of assembly, as shown in FIGS. 2-8. An isometric drawing of the assembly jig and top blank readied prior to assembly using the assembly method for corrugated skids in accordance with the invention is shown in FIG. 3. The top blank 31 is readied above the assembly jig 50. The top blank rib sections 33, 34, 35 are aligned above rib blades 52, 53 such that the blades will be inserted into the ribs as or when folded. Center rib portions 60 will align above center rib blades 52 and outer ribs 61 will align above outer rib blades 53. Top blank rib notches 62 will center above blade notches 54. Fork passage cut outs 44 will be in between center rib blades 52 and outer rib blades 53.

Figure 4:
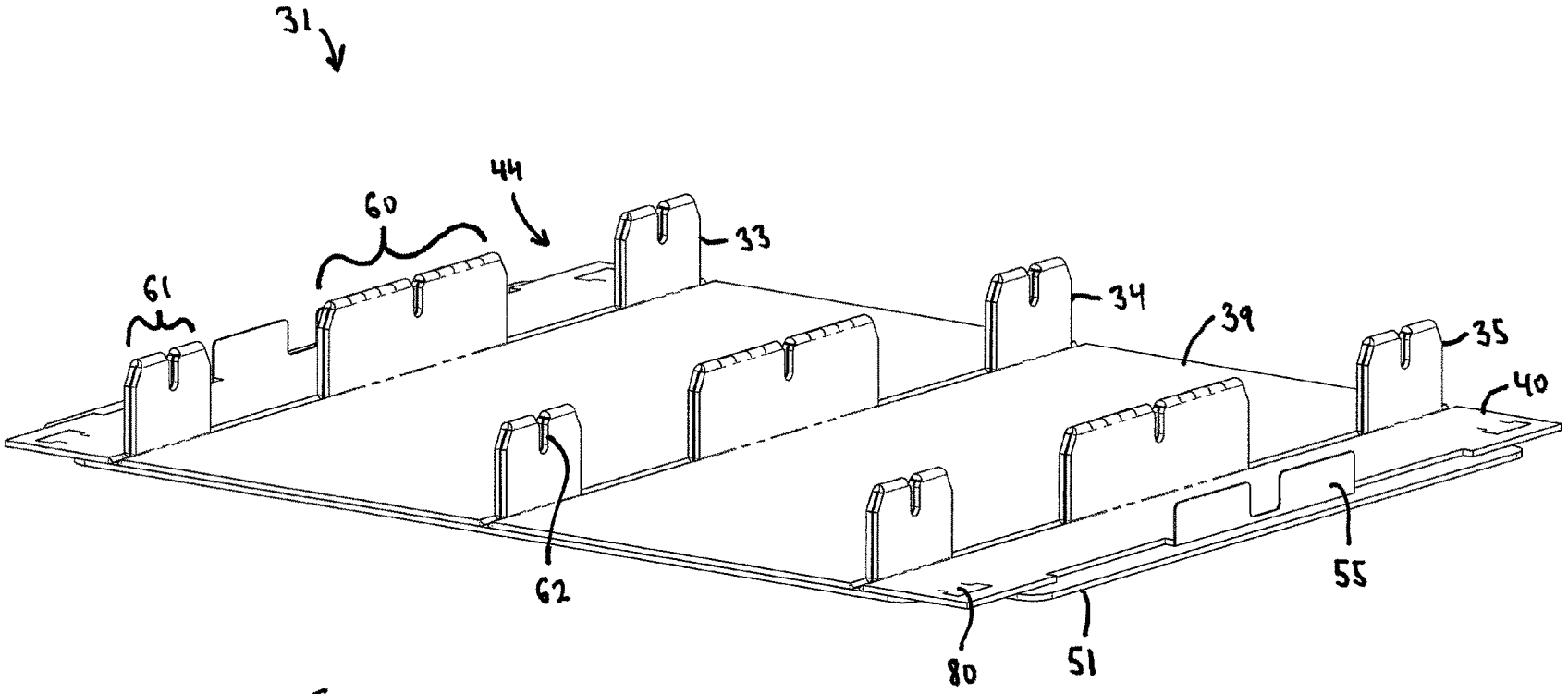
FIG. 4 is an isometric drawing of the top blank shown in FIG. 3, with ribs folded using the assembly method for corrugated skids in accordance with the invention.

As shown in FIG. 3, the top blank 31 has center or crest fold lines and root fold lines (not shown) where the ribs fold up from the blank 31, for three rows of ribs. The root fold lines are shown in co-pending U.S. patent application Ser. No. 14/999,860 filed on Jul. 11, 2016, the disclosure of which is incorporated herein by reference. The ribs 33, 34, 35, shown folded and mounted on the blades 52, 53 in FIG. 4, may be folded by hand and placed over the blades 53, 52, or the blades may be used to assist in folding the ribs. If the blades are used to assist folding the ribs, it is preferable that the blank 31 be placed over the first row of blades with the center fold line for the first row of ribs 33 aligned with the first line of blades, and then the blank be pressed down on the row of blades to form the ribs 33. Then, while the first row blades remains in the first row of ribs 31, the blank 31 be moved to align the center fold line of the second row of ribs 34 with the second row of blades 52, 53 and be pressed down to form the ribs around the second row of blades 52, 53. The third row of ribs would then be folded and fixed on the third row of blades in similar fashion. Finally, the two ends of the blank 31 would be tucked behind the end blades 55 to hold the two end sections 40 against the first and last row of blades. At this stage of the assembly process, as shown in FIG. 4, the top blank 31 is resting on and held in locked position by the assembly jig 50 as it sits on the assembly jig base plate 51. Top blank ribs 33, 34, 35 are held firmly in an upright position by the internal center and side blades 52, 53. Top blank rib notches 62 are centered over the middle of blade notches 54. Top deck portions 39, 40 rest on the assembly jig base plate 51. End assembly rib blades 55 keep the top blank 31 compressed in plane.

Figure 5:
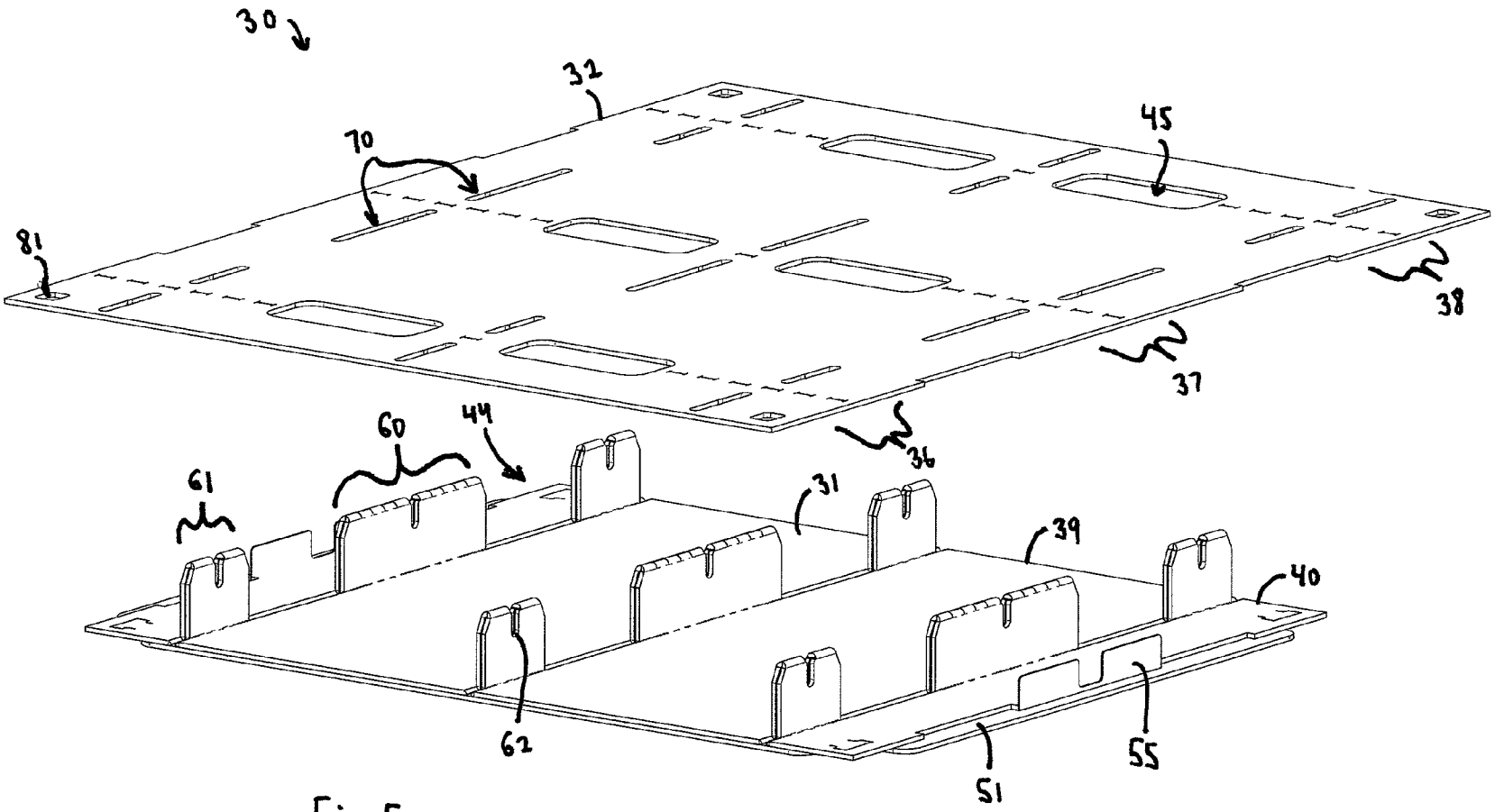
FIG. 5 is an isometric drawing of the top blank with ribs folded shown in FIG. 4, with bottom blank readied using the assembly method for corrugated skids in accordance with the invention.

In FIG. 5, the top blank 31 is shown with ribs folded and mounted on the blades 52, 53, and with bottom blank 32 readied to have the ribs folded in accordance with the same process used for forming the ribs on the top blank 31. The bottom blank 32 is placed above the top blank 31 that is resting on the base plate 51 of the skid assembly jig 50, with the rib fold lines of the bottom blank 32 oriented perpendicular to the rows of top blank ribs 33, 34, 35. The bottom blank 32 has rib sections 36, 37, 38 that are folded into ribs and slots 70 that will allow nesting over top blank center rib portion 60 and outer rib portions 61. The ribs 36, 37, 38 can be folded from the bottom blank 32 by hand or on a jig similar the jig 50 and then removed for assembling with the top blank 31.

Alternatively, the bottom blank ribs 36, 37, 38 could be formed in a bottom jig (not shown) having three elongated slots cut in positions corresponding to the positions that the ribs of the bottom blank would take when formed, and three cross slots in positions that the ribs 33, 34, 35 of the top blank 31 would take in the assembled skid. The bottom blank ribs 36, 37 38 would be formed and pushed into the elongated slots of the bottom jig, and then the two jigs would be brought together in vertical alignment to nest the two blanks 31, 32 together, with the top blank ribs penetrating bottom blank slots 70 and the top blank notches 62 engaging bottom blank notches 71. The top and bottom jigs would then be moved vertically apart, leaving nested top and bottom blanks of an assembled skid 30. This assembly variant would allow adhesive to be applied just before assembly and the two blanks to be firmly pressed together to ensure good contact with the glued surfaces for reliable adherence of the top and bottom blanks 31, 32.

Figure 6:
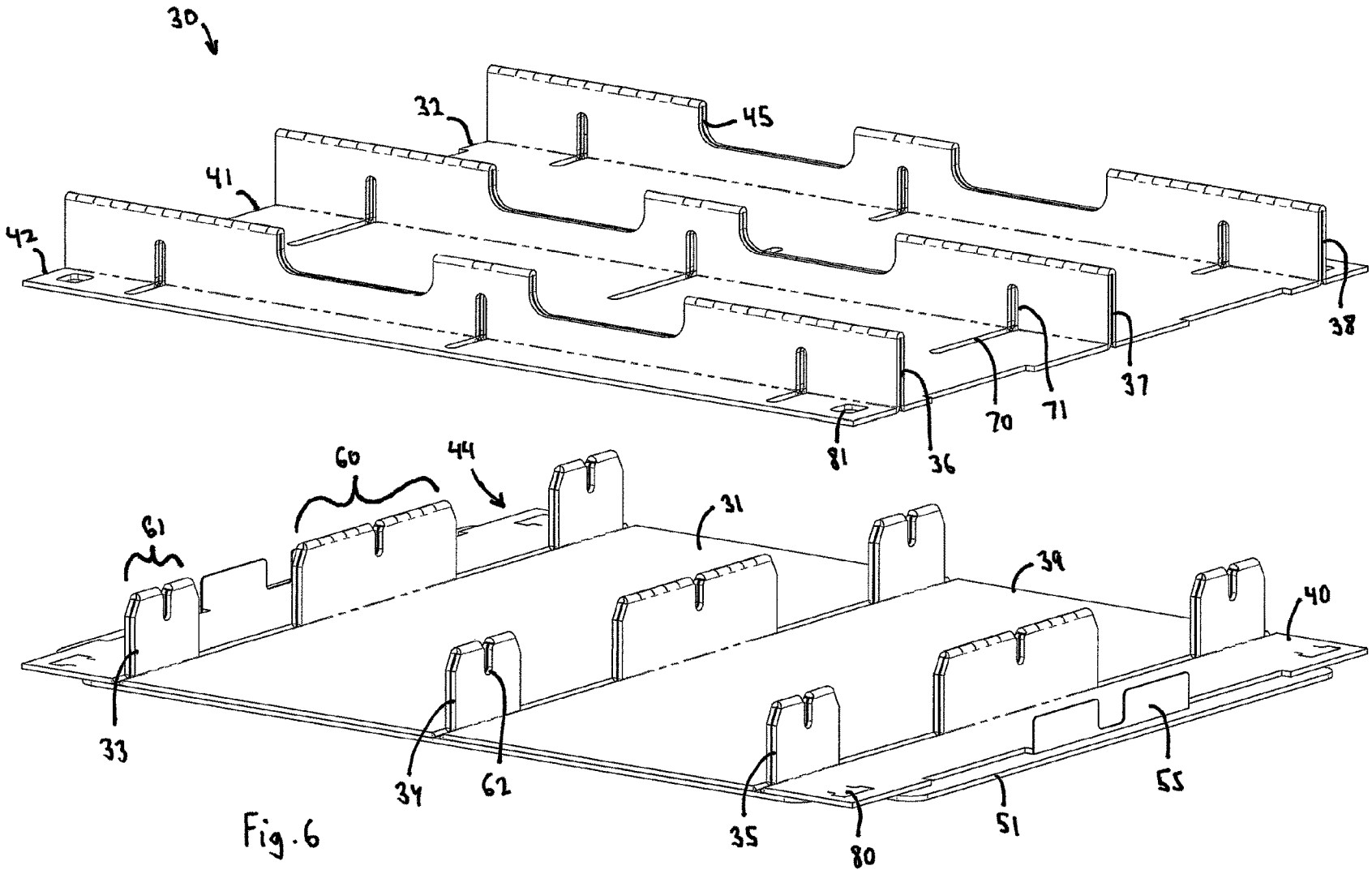
FIG. 6 is an isometric drawing the top blank with ribs folded shown in FIG. 4, with bottom blank ribs folded using the assembly method for corrugated skids in accordance with the invention.

In FIG. 6, the bottom blank 32, with bottom blank ribs 36, 37, 38 folded, is shown aligned over the top blank 31. The top blank 31 has upper deck portions 39, 40 that rest on the assembly jig backing plate 51, with blades 52, 53 holding the ribs 33, 34, 35 firmly in an upright position, and outer blades 55 preventing the blank 32 from expanding. The bottom blank 32 has ribs 36, 37, 38 folded between upper deck sections 41, 42, forming notches 71 and connected slots 70. Preferably, the slots 70 are a bit wider than the notches 71 and 62 so that the ribs 33, 34, 35 are easy to insert through the slots 70, but the notches 71 and 62 engage tightly to hold the ribs tightly together against spreading. The assembled skid 30 is then removed from the assembly jig 50. The bottom blank 32 is positioned above the top blank 31 so that center rib portions 60 of upper blank 31 align with the center rib 37 of bottom blank 32, and outer rib portions 61 of the top blank align with outer ribs 36, 38 of the bottom blank 32, and that ribs 33, 34, 35 can penetrate slots 70 upon lowering the bottom blank 32 onto the top blank 31. When the top and bottom blanks are nested, notches 62 will engage notches 71.

Figure 7:
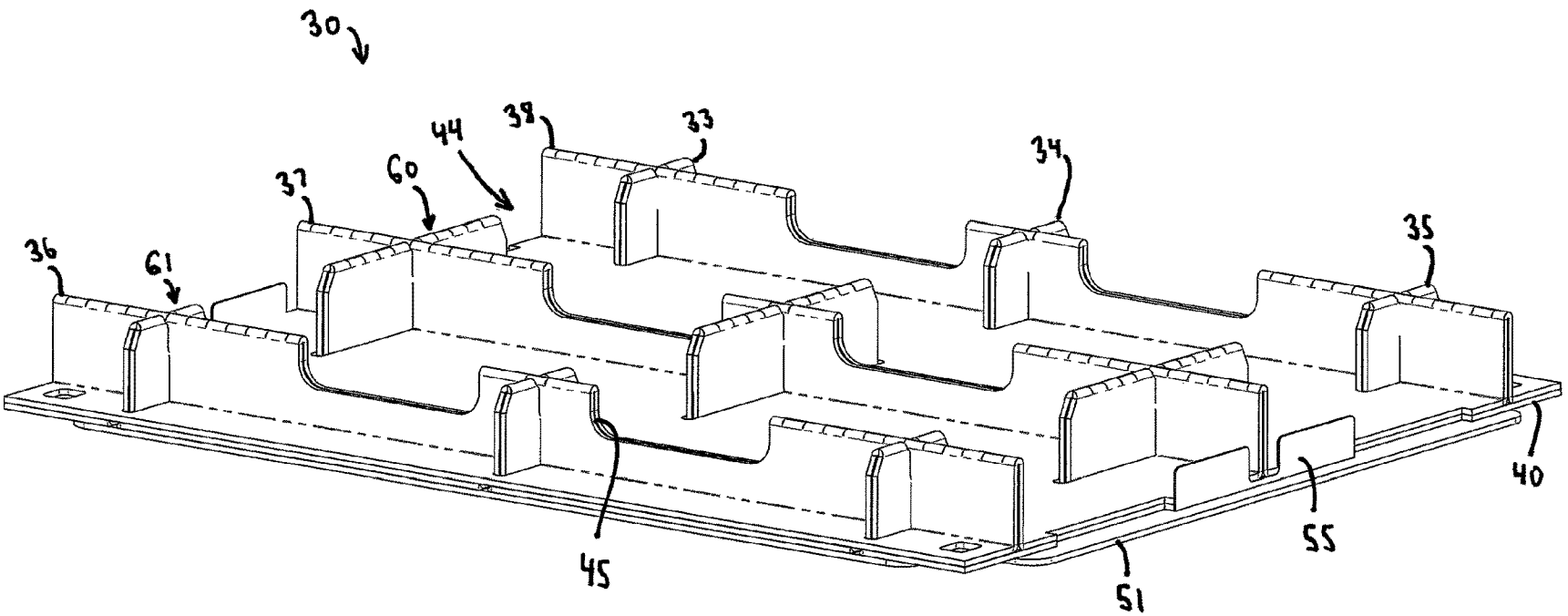
FIG. 7 is an isometric drawing of the top and bottom blanks with ribs folded shown in FIG. 6, with top and bottom blanks nested together using the assembly method for corrugated skids in accordance with the invention.

In FIG. 7, the top and bottom blanks with ribs folded as shown in FIG. 6, are shown nested together in accordance with the invention. The lower blank 32 is nested on top of the upper blank 31 while resting on the assembly jig backing plate 51. Ribs 36, 37, 38 intersect perpendicularly with ribs 33, 34, 35 while locking each other from opening. Center rib portions 60 of rib 34 lock center rib 37 and outer rib portions 61 lock outer ribs 36 and 38. Fork passages are formed between center and outer rib portions 60, 61.

Figure 8:
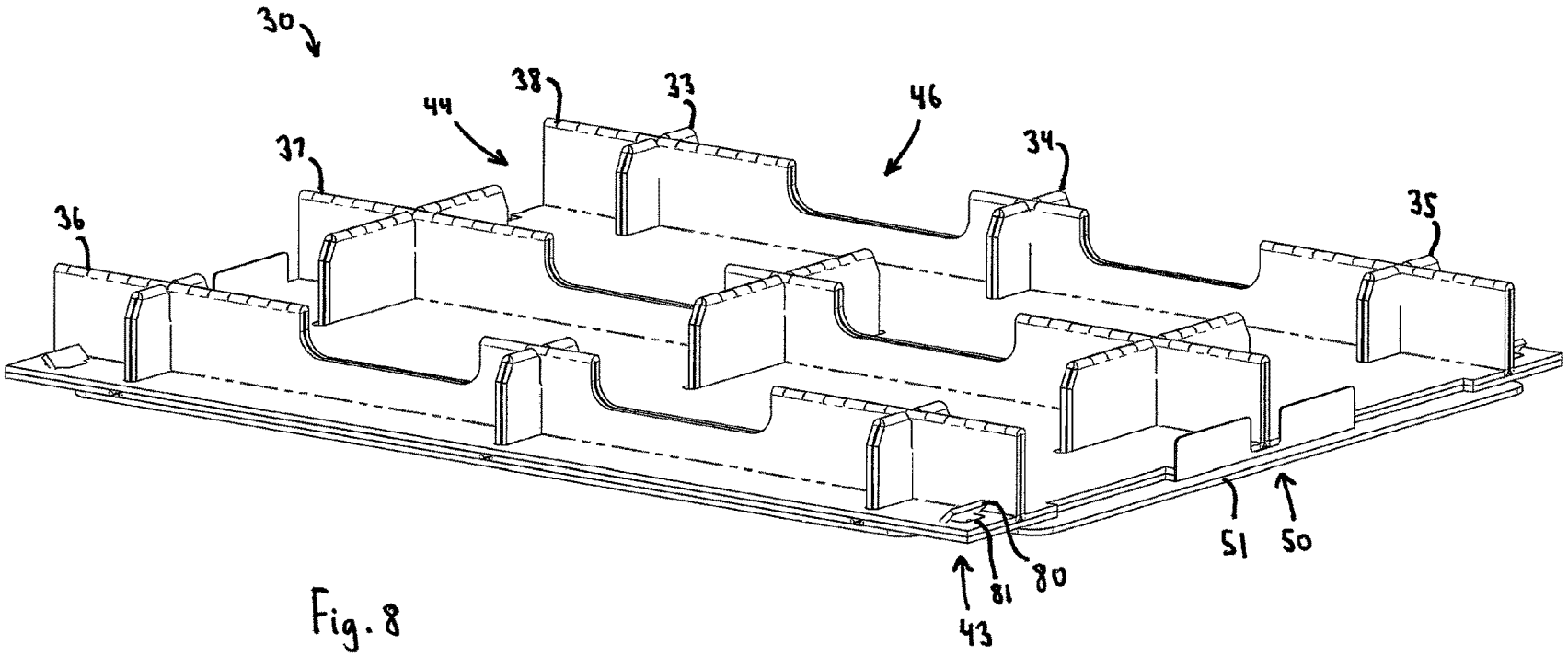
FIG. 8 is an isometric drawing of the nested top and bottom blanks shown in FIG. 7 with the top and bottom blanks locked together by corner locking using the assembly method for corrugated skids in accordance with the invention.

In FIG. 8, the nested top and bottom blanks shown in FIG. 7 are shown with corner locking in accordance with the invention, as one example of minimizing lateral translation of the two blanks 31, 32 relative to each other, thereby increasing the resistance to bending and improving the load carrying capacity of the skid. After nesting of the top blank 31 and bottom blank 32, the blanks are locked together by assembling the corner locks 43. Top blank corner locking tabs 80 are pushed through bottom blank corner locking openings 81. Other methods of locking the top and bottom blanks that could be used include adhesives, edge fastening, and punch locks. The skid 30 can be removed from the assembly jig 50 and flipped over, as shown in FIG. 1, to provide a light weight, strong shipping platform having fork passages 44 and fork lift notches 46.

Obviously, numerous modifications and variations of the described preferred embodiment are possible and will occur to those skilled in the art in light of this disclosure of the invention accordingly, I intend that these modifications and variations, and the equivalents thereof, be included within the spirit and scope of the invention as defined in the following claims, wherein we claim:

1. A method for assembling corrugated skids comprising:

selecting two planar corrugated blanks and folding one of said blanks to produce a first double thickness rib that extends out of the plane of said one blank;

placing said one blank on a horizontal surface having blades protruding upwards, wherein said blades penetrate the middle of said first double thickness rib and holds said first double thickness rib perpendicular with said horizontal surface;

folding a second of said blanks to produce a second double thickness rib that extends out of the plane of said second blank; and placing said second blank on top of said one blank such that said first double thickness rib penetrates a slot in said second blank.

2. A method as defined in claim 1, wherein:

said one planar corrugated blank and said second corrugated blank are each folded to produce at least two first double thickness ribs and two second double thickness ribs, respectively, and said horizontal surface has end stops spaced such that said blades hold said first ribs of said one blank in an upright position to facilitate assembly with said second blank, and said end stops prevent one blank ribs from expanding laterally and unfolding after being folded and placed on said horizontal surface.

3. A method as defined in claim 2 wherein:

said blades are spaced apart the same distance as the distance between said first double thickness ribs on said one blank when said first double thickness ribs on said one blank ribs are folded from said one blank.

4. A method as defined in claim 2 further comprising:

said blades include multiple blades placed in a row to support separated rib sections that provide for fork passages of said skid between said sections.

5. A method as defined in claim 2 wherein:

said one blank has multiple rows of said ribs, and said blades maintain multiple ribs at the same upright angle of inclination.

6. A method as defined in claim 1 wherein:

said blades have a height from said horizontal surface that is less than 75% of the height of said first and second ribs.

7. A method as defined in claim 1 further comprising:

end stops aligned with said one blank on said horizontal surface to prevent said rib of said one blank from expanding laterally.

8. A method as defined in claim 1 further comprising:

said blades have notches in a top edge to allow for clearance of said second blank ribs during assembly.

9. A method as defined in claim 1 further comprising:

pressing said one blank against said blades to help to form said first double thickness rib.

10. A method as defined in claim 1 further comprising:

restraining ends of said one blank with end blades to prevent said first double thickness rib from opening after being folded.

11. A method of assembling corrugated skids on an assembly structure having first and second rows of blades, said method comprising:

selecting first and second planar blanks made of corrugated material having first and second rib crest fold lines and root fold lines impressed in said blanks for at least first and second rows of ribs respectively, on each blank;

engaging said first blank with a first row of blades protruding from said assembly structure, said first row of blades first engaging said first blank on a rib crest fold line for a first row of said ribs;

pressing said first blank and said first row of blades together to fold said ribs along said crest and root fold lines over said first row of blades, with said first row of blades being sandwiched between double thicknesses of said first row of ribs to hold said first row of ribs stationary and extending out of the plane of one side of said first blank while subsequent assembly steps are performed.

12. A method as defined in claim 11, further comprising:

moving relative positions of portions of said first blank that have said second crest and root fold lines for said second row of ribs and said second row of blades to align said second crest fold line for said second row of ribs with said second row of blades;

engaging said first blank at said second crest fold line, with said second row of blades protruding from said assembly structure, while said first row of blades remains sandwiched between said double thicknesses of said first row of ribs, holding said first row of ribs stationary and while subsequent assembly steps are performed; and pressing said first blank and said second row of blades together to fold said ribs along said second crest and root fold lines over said second row of blades, with said first row of blades being sandwiched between said double thicknesses of said first row of ribs to hold said first row of ribs stationary while subsequent assembly steps are performed.

13. A method as defined in claim 12, further comprising:

folding said second blank to produce at least two rows of double thickness ribs that extend out of the plane of one side of said second blank, terminating in a rib crest, and open on an opposite side of said second blank; and engaging said first and second blanks with said one side of said first blank facing said opposite side of said second blank, such that said double thickness ribs of said first blank penetrate slots in said second blank, whereby said blanks are nested with said one side of said first blank in face-to-face contact with said opposite side of said second blank, forming a double thickness skid deck with said ribs forming depending legs for supporting said skid deck above a supporting surface.

14. A method as defined in claim 11, further comprising:

locking said first and second blanks together in face-to-face contact to prevent relative parallel lateral translation therebetween to improve the bending stiffness of said skid deck.

15. A method as defined in claim 14, wherein:

said locking step includes one of said blanks has openings aligned with locking tabs when said blanks are nested, and said tabs are pushed through said openings to lock said blanks to minimize lateral translation of said blanks relative to each other, thereby increasing to bending stiffness and improving load carrying capacity of said skid.

16. A method for assembling corrugated skids comprising:

selecting first and second planar blanks made of corrugated material having fold lines impressed in said blanks, each of said blanks having first and second opposite planar sides;

folding said first blank along said fold lines to produce at least two double thickness ribs that extend out of the plane of said first side of said first blank, said ribs being open between said double thicknesses of said ribs on said second side, and having a crest on said first side;

engaging said first blank with blades protruding from a supporting surface, wherein said blades penetrate said open side of said ribs between said double thicknesses of said ribs on said second side and maintain said ribs in a perpendicular orientation with said surface;

folding said second blank to produce at least two double thickness ribs that extend out of the plane of said first side of said second blank; and engaging said first and second blanks, with said first side of said first blank facing said second side of said second blank, such that said double thickness ribs of said first blank, while being held in a perpendicular orientation with said surface, penetrate slots in said second blank, and said blanks are nested with said first side of said first blank in face-to-face contact with said second side of said second blank.

17. A method as defined in claim 16, wherein:

said ribs of said first and second blanks are oriented orthogonally to one another.

18. A method as defined in claim 16, wherein:

said ribs of said first and second blanks intersect at notches in said first and second ribs when assembled together, with said ribs of said second blank protruding into notches in said blades with which said second blank ribs are aligned during assembly, and said notches in said first and second ribs are slotted together such that said rib crests are aligned in a plane parallel to said blanks.

19. A method as defined in claim 16, wherein:

said second blank has openings aligned with locking tabs in said first blank when said blanks are nested, and said tabs are pushed through said openings to lock said blanks together, so as to minimize lateral translation of said blanks relative to each other, thereby increasing bending stiffness and improving load carrying capacity of said skid.

20. A method as defined in claim 16, wherein:

said first blank is restrained from longitudinal movement during assembly by engagement with stops that are aligned with the plane of said first blank.

* * * * *